US011364509B2

(12) United States Patent
Sturdy et al.

(10) Patent No.: US 11,364,509 B2
(45) Date of Patent: Jun. 21, 2022

(54) NOZZLE ASSEMBLY WITH ARTICULATING NOZZLES

(71) Applicant: Sturdy Corporation, Wilmington, NC (US)

(72) Inventors: David R. Sturdy, Wilmington, NC (US); Melvin R. Phillips, Carolina Beach, NC (US); James T. Carter, Wilmington, NC (US); Ethan T. Ogburn, Wilmington, NC (US); Daniel B. Eaddy, Wilmington, NC (US)

(73) Assignee: Sturdy Corporation, Wilmington, NC (US)

( * ) Notice: Subject to any disclaimer, the term of this patent is extended or adjusted under 35 U.S.C. 154(b) by 288 days.

(21) Appl. No.: 16/513,243

(22) Filed: Jul. 16, 2019

(65) Prior Publication Data

US 2020/0023386 A1 Jan. 23, 2020

Related U.S. Application Data

(60) Provisional application No. 62/699,882, filed on Jul. 18, 2018.

(51) Int. Cl.

| | |
|---|---|
| ***B05B 1/14*** | (2006.01) |
| ***B05B 15/68*** | (2018.01) |
| ***B05B 1/02*** | (2006.01) |

(52) U.S. Cl.

CPC ..... *B05B 1/14* (2013.01); *B05B 1/02* (2013.01); *B05B 15/68* (2018.02)

(58) Field of Classification Search

CPC .. B05B 1/14; B05B 15/68; B05B 1/02; B05B 13/0421; B05B 15/652; B05B 15/00; B05B 17/08

See application file for complete search history.

(56) References Cited

U.S. PATENT DOCUMENTS

| | | | | |
|---|---|---|---|---|
| 3,971,074 A * | 7/1976 | Yxfeldt | ..... | E03D 9/085 4/570 |
| 4,111,363 A | 9/1978 | Kawamura et al. | | |
| 6,053,423 A * | 4/2000 | Jacobsen | ..... | B05B 17/08 239/18 |

(Continued)

FOREIGN PATENT DOCUMENTS

| | | |
|---|---|---|
| JP | 08141458 A | 4/1996 |
| KR | 100924802 B1 | 11/2009 |

(Continued)

OTHER PUBLICATIONS

"Extended European Search Report", European Patent Office, EP Application No. 19838222.8, dated Feb. 6, 2021.

(Continued)

*Primary Examiner* — Qingzhang Zhou

(74) *Attorney, Agent, or Firm* — Ward and Smith, P.A.; Ryan K. Simmons

(57) ABSTRACT

A nozzle including a plurality of moveable nozzles configured to transition between a first state in which streams produced by the nozzles combine to form a collective stream, or the appearance of a collective stream, and at least one second state in which the nozzles produce separate respective streams; and a drive mechanism configured to transition the nozzles between the first and second states.

22 Claims, 16 Drawing Sheets

(56) References Cited

U.S. PATENT DOCUMENTS

| | | | | |
|---|---|---|---|---|
| 6,076,741 | A * | 6/2000 | Dandrel | E03C 1/0408 239/18 |
| 6,151,824 | A * | 11/2000 | Clayton | F41A 21/48 124/69 |
| 8,459,573 | B2 | 6/2013 | Wiseman et al. | |
| 9,315,974 | B2 | 4/2016 | Brown et al. | |
| 10,376,905 | B2 * | 8/2019 | Yang | B05B 1/18 |
| 2007/0246577 | A1 | 10/2007 | Leber | |
| 2011/0132994 | A1 | 6/2011 | Wiseman et al. | |

FOREIGN PATENT DOCUMENTS

| | | | |
|---|---|---|---|
| KR | 20-2010-0001372 | * | 12/2010 |
| KR | 20100001372 U | | 2/2011 |

OTHER PUBLICATIONS

International Search Report and Written Opinion received for PCT International Application No. PCT/US2019/041994, dated Oct. 16, 2019, 11 pages.

* cited by examiner

NOZZLE ASSEMBLY WITH ARTICULATING NOZZLES

RELATED APPLICATIONS

This application claims priority and is related to U.S. Provisional Patent Application Ser. No. 62/699,882 entitled "Nozzle Assembly with Articulating Nozzles," filed Jul. 18, 2018, the contents of which are incorporated herein by reference in its entirety.

BACKGROUND

Water displays (e.g., decorative fountains) typically use devices, such as water propulsion devices, that eject water into the air. These devices commonly employ static water nozzles that are limited in terms of dynamic reconfiguration. For example, such conventional nozzles may not be capable of dynamically changing the stream output aside from the height of the water stream. If the user desires to change the type of stream output from the nozzle, a manual nozzle change can be done, but this is typically a labor intensive operation that cannot be done during a show.

SUMMARY OF THE INVENTION

Some embodiments of the inventive subject matter provide a multi-stream nozzle assembly having one or more articulating nozzles that can provide one or more streams that can be spread out, combined into one stream, give the appearance of one stream, or modify the output water's appearance in any way. The device can be operated whether water is or is not flowing. A nozzle assembly according to some embodiments can modify the appearance of its output without requiring a physical changing of parts, such as nozzles. The nozzle assembly may be independent or attached to a water propulsion device.

Further embodiments provide a nozzle assembly that provides streams from more than one exit point and has the ability to rotate. When in a first state, the assembly can output one or more collective streams generated from multiple exit orifices. These streams may be collective or give the appearance of being collective. In other states, the nozzle assembly can provide separate streams at varying angles from the various nozzles thus giving the appearance of a different number of streams from the first state. The state of the nozzle assembly can be changed irrespective of whether it is producing streams.

In an embodiment, a nozzle assembly is provided. The assembly may include moveable nozzles configured to transition between a first state in which streams produced by the moveable nozzles combine to form a given number of streams, or the appearance of a given number of streams, and at least one second state in which the moveable nozzles produce a different number of streams, or the appearance of a different number of streams from the first state; and a drive mechanism configured to transition the moveable nozzles between the first and second states. Each of the moveable nozzles may be configured to move between a closed (vertical) position and an open (inclined) position. The moveable nozzles may include a first set of moveable nozzles that pivot about a first axis and a second set of moveable nozzles that pivot around a second axis parallel to the first axis. The first set of moveable nozzles may include a first nozzle having movement that stops at a first angle with respect to the closed (vertical) position and a second nozzle having movement that stops at a second angle with respect to the closed (vertical) position. The moveable nozzles may include a first set of moveable nozzles that move along a first plane and a second set of moveable nozzles that move along a second plane parallel to the first plane. The drive mechanism may include a sliding member configured to move vertically and wherein the moveable nozzles may be linked to the sliding member such that the moveable nozzles move between the closed (vertical) position and the opened (inclined) positions responsive to vertical movement of the sliding member. The drive mechanism may include a rotating or gear driven member configured such that the nozzles move between the closed (vertical) and open (inclined) positions responsive to rotational movement of the drive member. The assembly may further include one or more stationary nozzles. The one or more stationary nozzles may be configured to contribute to the collective stream when the moveable nozzles are in the first state. The moveable nozzles may surround the one or more stationary nozzles when the moveable nozzles are in the first state. The moveable nozzles may include a first set of moveable nozzles that pivot about a first axis on a first side of the stationary nozzle and a second set of moveable nozzles that pivot around a second axis parallel to the first axis on a second side of the stationary nozzle. A first nozzle of the first set of moveable nozzles may include a first nozzle that stops at a first angle of inclination with respect to vertical and a second nozzle that stops at a second angle of inclination with respect to vertical. The moveable nozzles may include a first set of moveable nozzles that move along a first plane on a first side of the stationary nozzle and a second set of moveable nozzles that move along a second plane parallel to the first plane on a second side of the stationary nozzle. A first nozzle of the first set of moveable nozzles may include a first nozzle that stops at a first angle of inclination with respect to vertical and a second nozzle that stops at a second angle of inclination with respect to vertical. The assembly may further include a light system, wherein the nozzle assembly and light system may be operatively connected together and configured to operate in coordination with one another to generate a dynamically changing defined water display. The light system may include one or more light panels; and one or more lights arranged in the one or more light panels, wherein the lights are capable of producing white light or colored lighting. The one or more light panels may be arranged about the nozzle assembly. The lights may be arranged such that an angle of illumination can be controlled in either spherical or cartesian coordinates. The lights may be arranged such that a width of illumination can be controlled in either spherical or cartesian coordinates. The assembly may further include a controllable mount, wherein the nozzle assembly may be operatively connected to the controllable mount. The controllable mount may include a mount base; and a mount arm affixed to the mount base. The controllable mount may further include a control box. The nozzle assembly may be operatively attached to the mount arm. The assembly may further include a light system, wherein the nozzle assembly and light system may be operatively connected to the controllable mount and configured to operate in coordination with one another to generate a dynamically changing defined water display.

DETAILED DESCRIPTION

Figure 1:
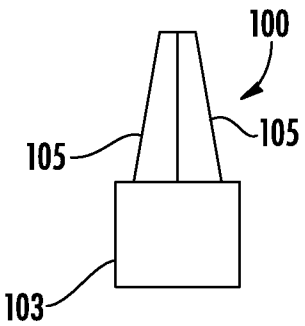
FIG. 1 is a side view of a multi-stream nozzle assembly in a first state according to some embodiments.

Specific exemplary embodiments of the inventive subject matter now will be described with reference to the accompanying drawings. This inventive subject matter may, however, be embodied in many different forms and should not be construed as limited to the embodiments set forth herein; rather, these embodiments are provided so that this disclosure will be thorough and complete, and will fully convey the scope of the inventive subject matter to those skilled in the art. In the drawings, like numbers refer to like elements. It will be understood that when an element is referred to as being "connected" or "coupled" to another element, it can be directly connected or coupled to the other element or intervening elements may be present. As used herein the term "and/or" includes any and all combinations of one or more of the associated listed items.

The terminology used herein is for the purpose of describing particular embodiments only and is not intended to be limiting of the inventive subject matter. As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive subject matter belongs. It will be further understood that terms, such as those defined in commonly used dictionaries, should be interpreted as having a meaning that is consistent with their meaning in the context of the specification and the relevant art and will not be interpreted in an idealized or overly formal sense unless expressly so defined herein.

FIGS. 1-6 depict an example embodiment of a nozzle assembly 100 affixed to, for example, a water delivery device 103. The nozzle assembly 100 may include four articulating nozzles 105, each with an orifice 110. An alternate embodiment of the nozzle assembly 100 may include more or less articulating nozzles 105 and/or members which do not move that also contain an orifice 110.

Figure 2:
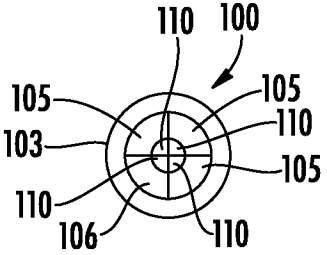
FIG. 2 is a top view of the nozzle assembly of FIG. 1.
Figure 5:
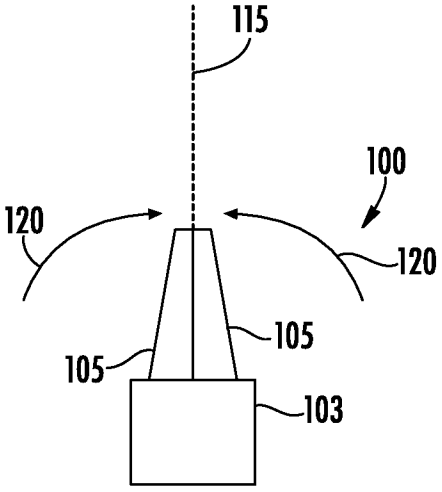
FIG. 5 is a side view of the nozzle assembly of FIG. 1 in the first state producing an exemplary collective stream.

FIGS. 1, 2, and 5 depict the nozzle assembly 100 in an example closed position. FIG. 1 depicts a side view of the nozzle assembly 100 in the closed position, while FIG. 2 depicts a top view of the nozzle assembly 100 in the closed position. FIG. 5 illustrates the nozzle assembly 100 in the closed position producing a single collective stream 115 (or give the appearance of a collective stream) from streams produced by the articulating nozzles 105.

Figure 3:
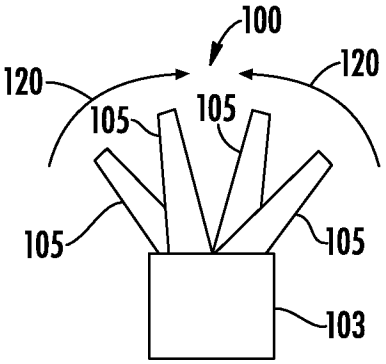
FIG. 3 is a side view of the nozzle assembly of FIG. 1 in a second state.
Figure 4:
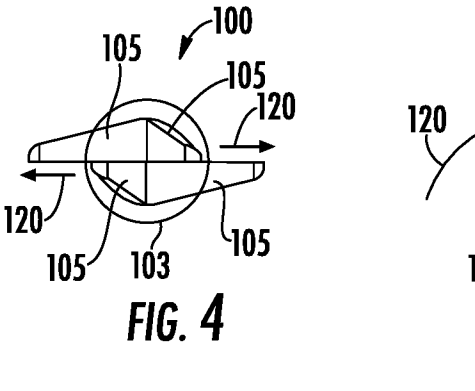
FIG. 4 is a top view of the nozzle assembly of FIG. 4 in the second state.
Figure 6:
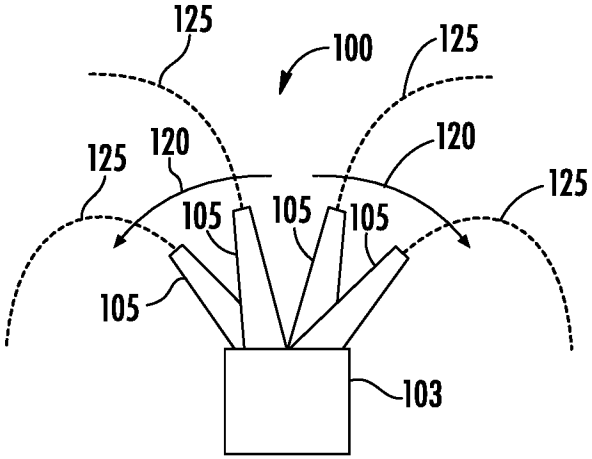
FIG. 6 is a side view of the nozzle assembly of FIG. 4 in the second state producing exemplary multiple streams.

FIGS. 3, 4, and 6 depict the nozzle assembly 100 in an example open (inclined) position. The position depicted is one of a number of open positions in which the nozzle assembly 100 may operate, from the fully closed (vertical) position of FIGS. 1, 2, and 5 to a fully open (inclined) position in which the articulating nozzles 105 are deflected from the vertical (closed) positions shown in FIGS. 1, 2, and 5. Example movement of the articulating nozzles 105 of the nozzle assembly 100 is depicted by arrows 120 in FIGS. 3-6. The articulating nozzles 105 are shown to move in a linear direction, an alternate construction of the device may have articulating nozzles 105 that move in any direction. FIG. 3 depicts a side view of the nozzle assembly 100 in an open position, while FIG. 4 depicts a top view of the nozzle assembly 100 in an open position. FIG. 6 illustrates the nozzle assembly 100 producing multiple streams 125 from the respective nozzles 105 in an open position. In the fully closed position, the nozzle assembly 100 successfully combines, or provides the appearance of combining, the individual output streams 125 into larger single output stream 115, or give the appearance of a single output stream 115.

Figure 7:
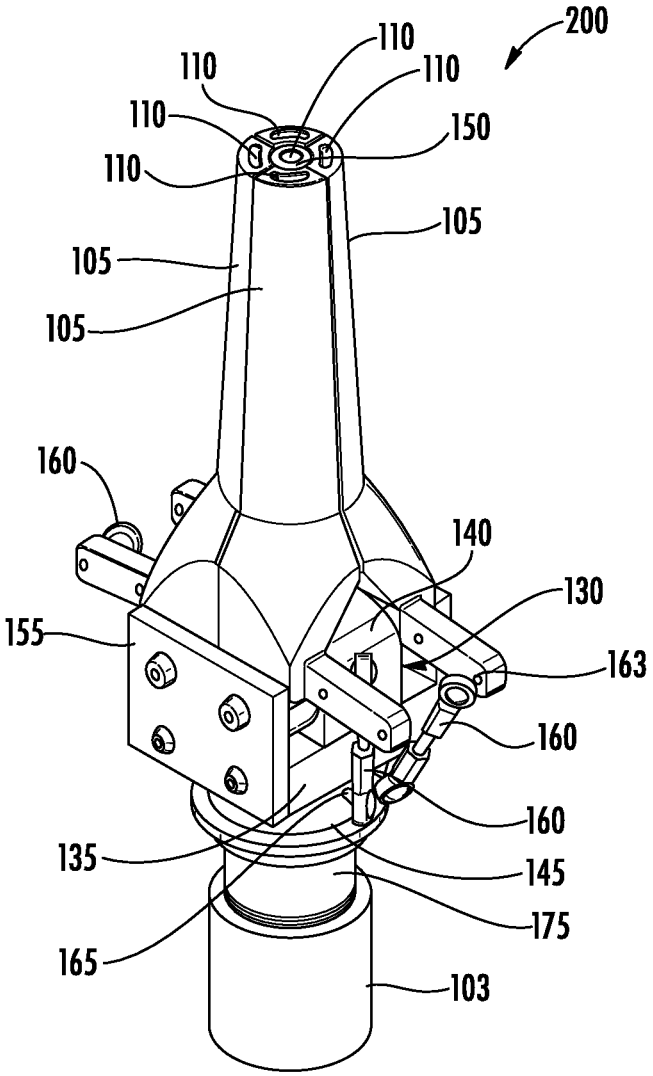
FIG. 7 is a perspective view of a multi-stream nozzle assembly in a first state according to further embodiments.
Figure 8:
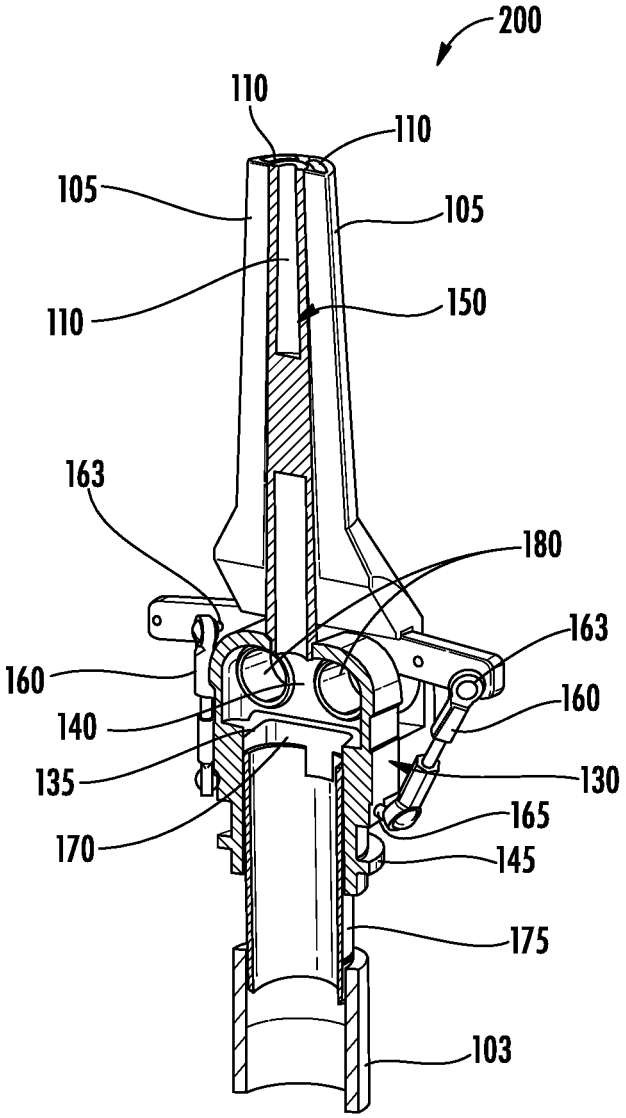
FIG. 8 is a section view of the multi-stream nozzle assembly of FIG. 7.
Figure 9:
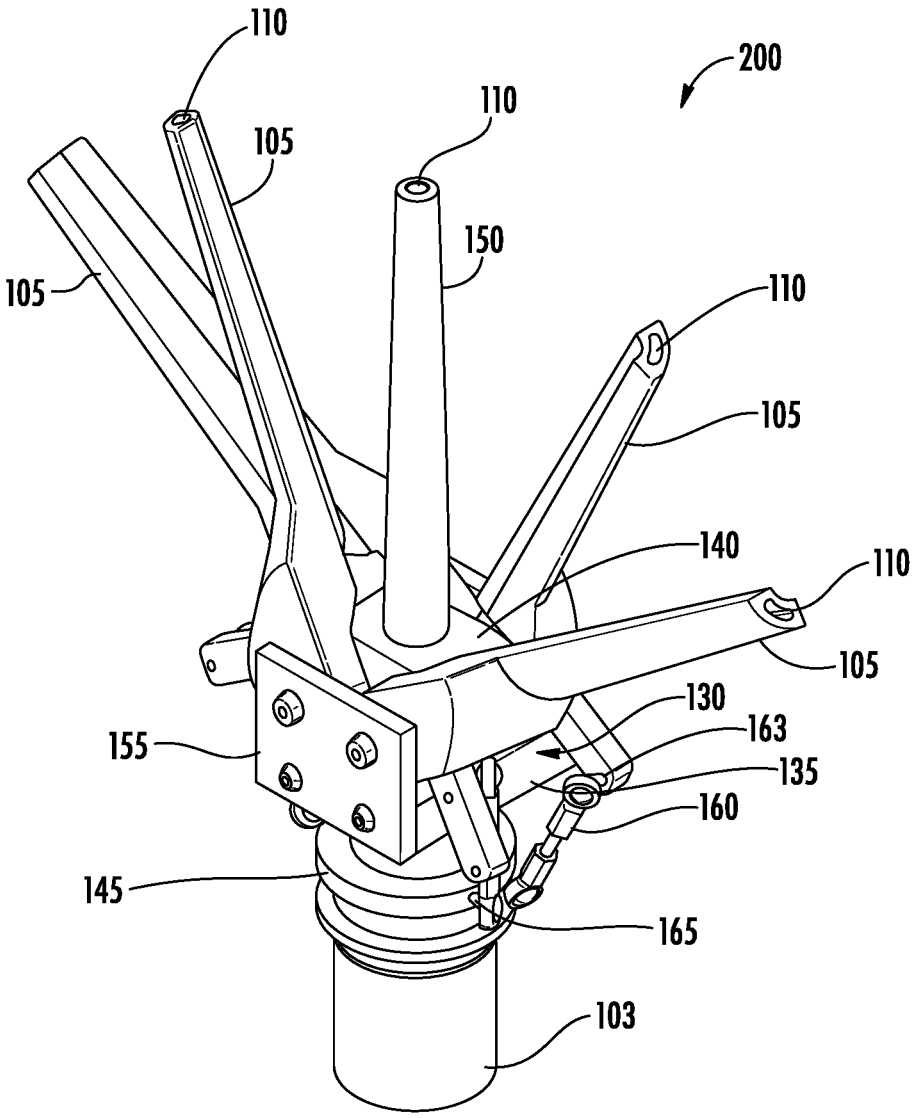
FIG. 9 is a perspective view of the multi-stream nozzle assembly of FIG. 7 in a second state.
Figure 10:
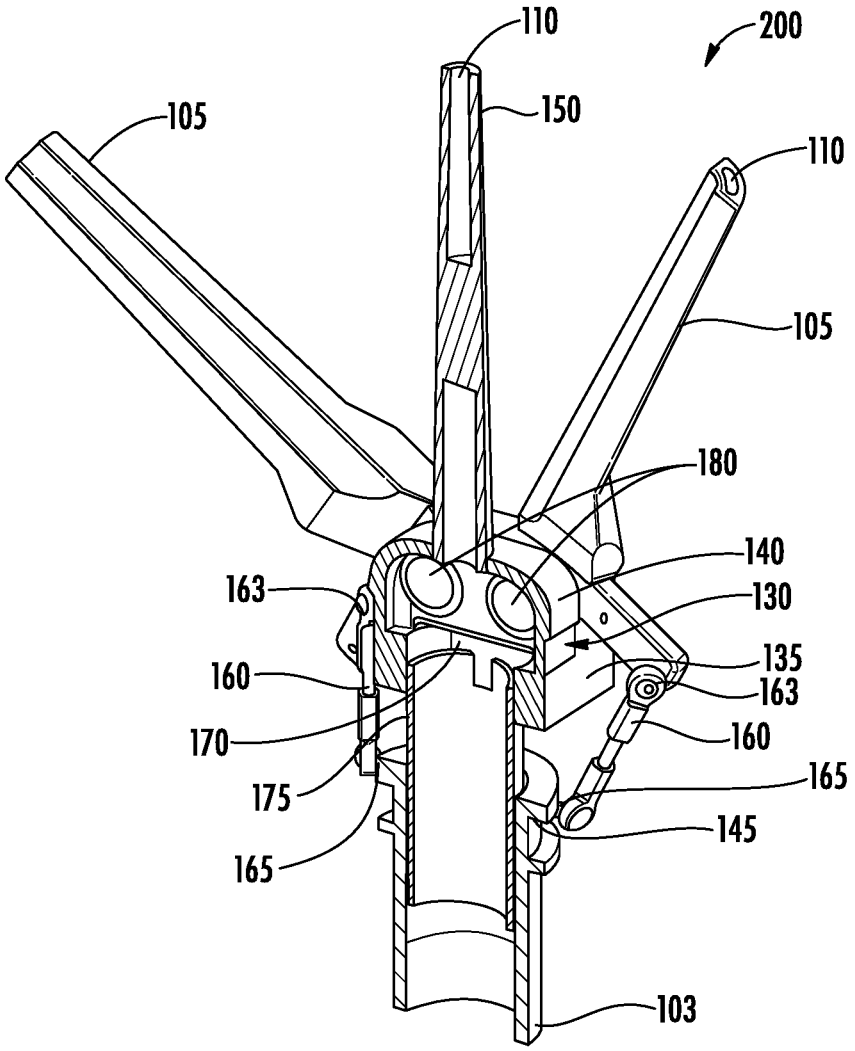
FIG. 10 is a section view of the multi-stream nozzle assembly of FIG. 9.
Figure 11:
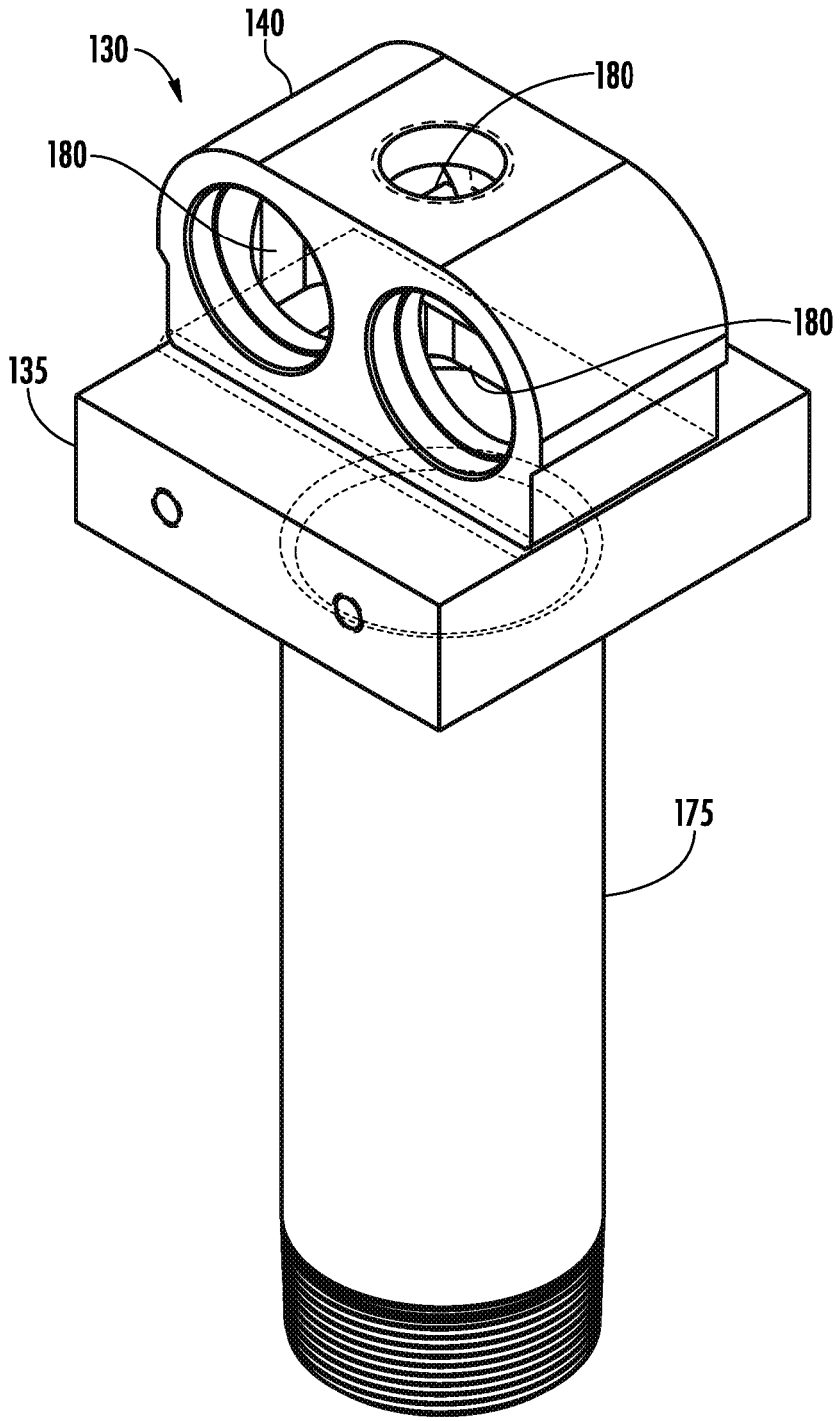
FIG. 11 is a perspective view of a water manifold of the multi-stream nozzle assembly of FIGS. 7 and 9.
Figure 12:
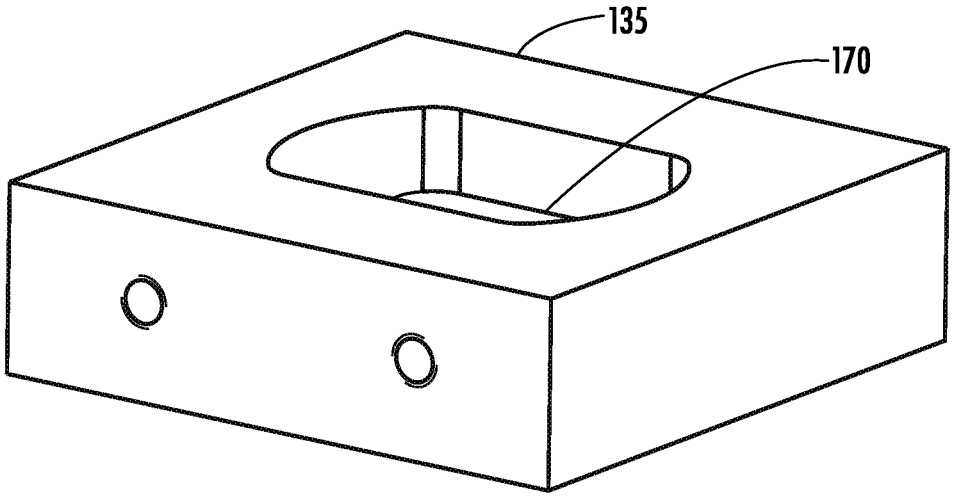
FIG. 12 is a perspective view of a water inlet manifold of the water manifold of FIG. 11.
Figure 13:
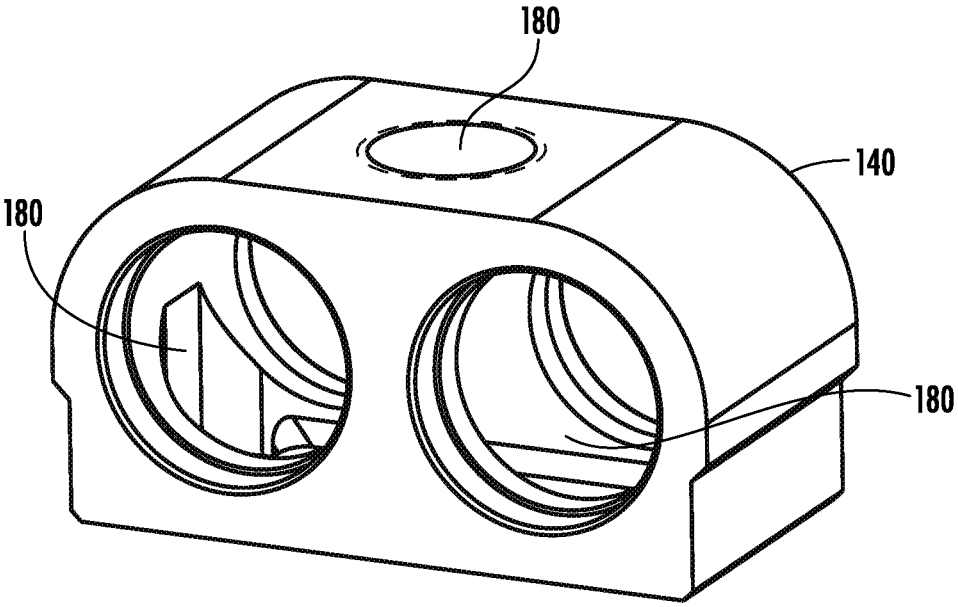
FIG. 13 is a perspective view of a water outlet manifold of the water manifold of FIG. 11.
Figure 14:
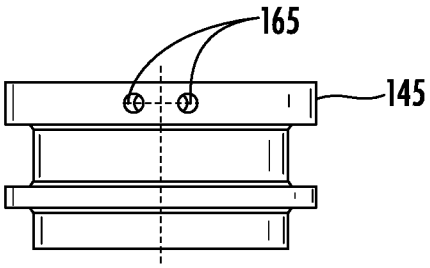
FIG. 14 is a perspective view of a slide member of the multi-stream nozzle assembly of FIGS. 7 and 9.
Figure 15:
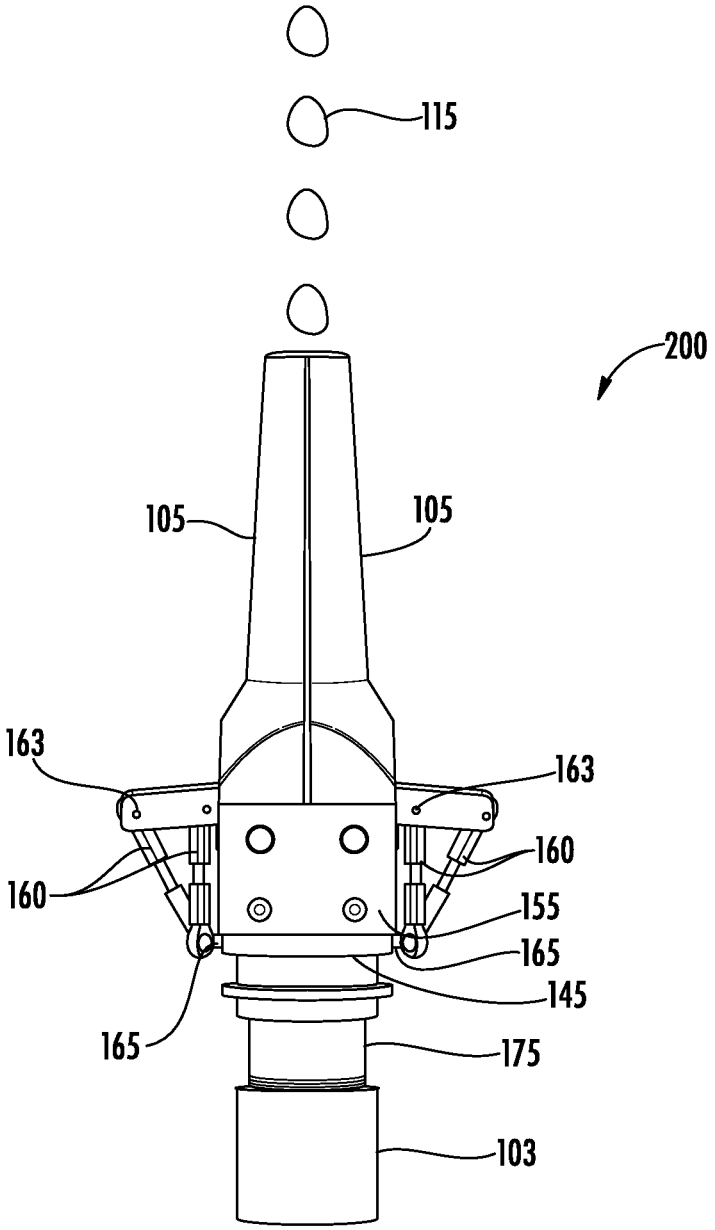
FIG. 15 is a side view of the multi-stream nozzle assembly of FIG. 7 in the first state producing an exemplary collective water stream.

A nozzle assembly 200 according to further embodiments is described with references to FIGS. 7-17. FIGS. 7, 8, and 15 depict the nozzle assembly 200 in an example closed (vertical) position (e.g., output stream representative of, or appearing as a single output stream 115 configuration). FIGS. 9, 10, 16 and 17 depict the nozzle assembly 200 in an example open (inclined) position (e.g., multiple output streams 125 configuration). FIG. 11 depicts a water manifold 130 of the nozzle assembly 200, and FIGS. 12 and 13 depict a water inlet manifold 135 and a water manifold outlet 140, respectively, of the water manifold 130. FIG. 14 depicts a slide member 145 of the nozzle assembly 200.

Figure 18A:
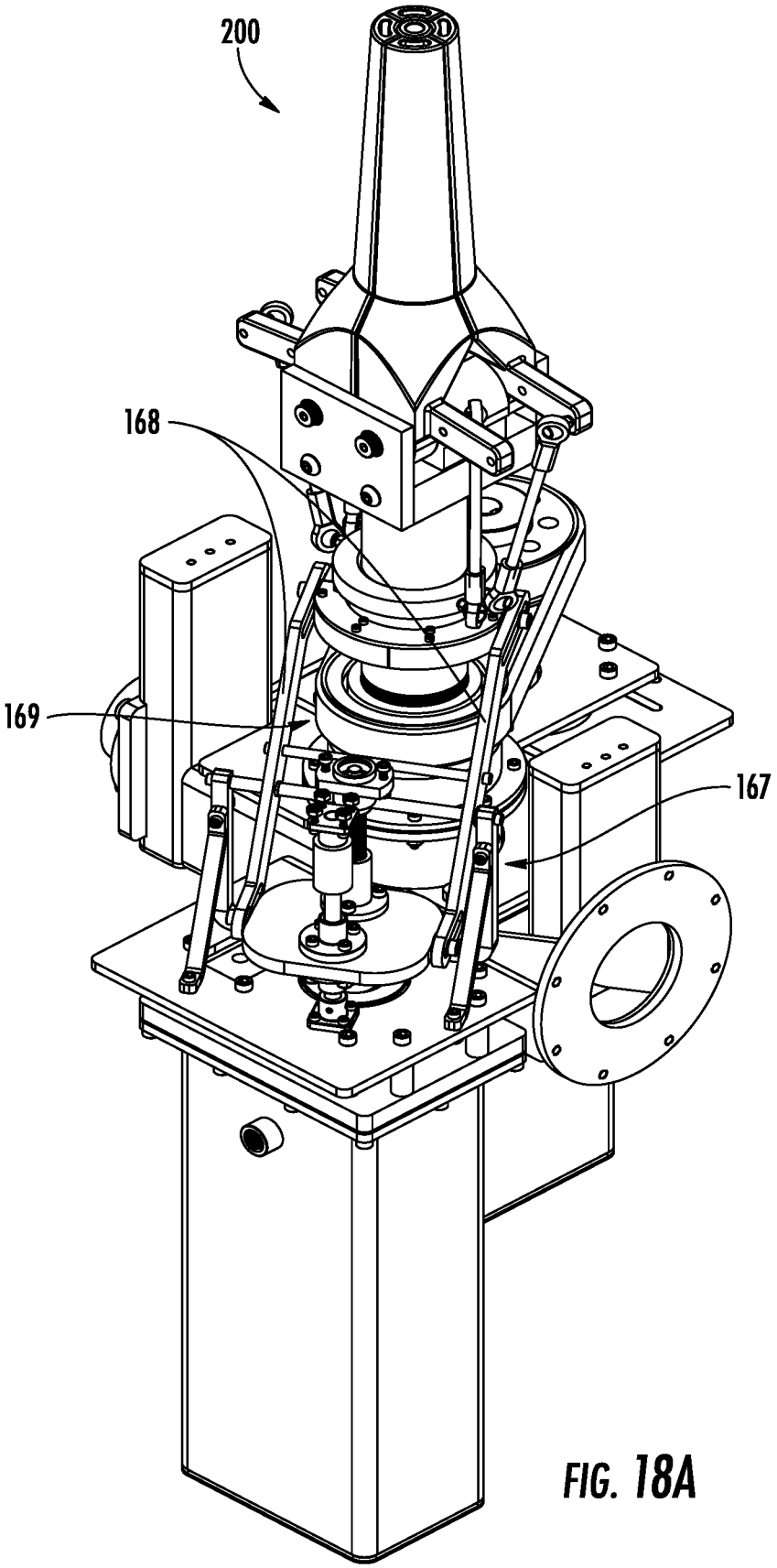
FIGS. 18A, 18B, and 18C are additional various perspective views of the multi-stream nozzle assembly.
Figure 18B:
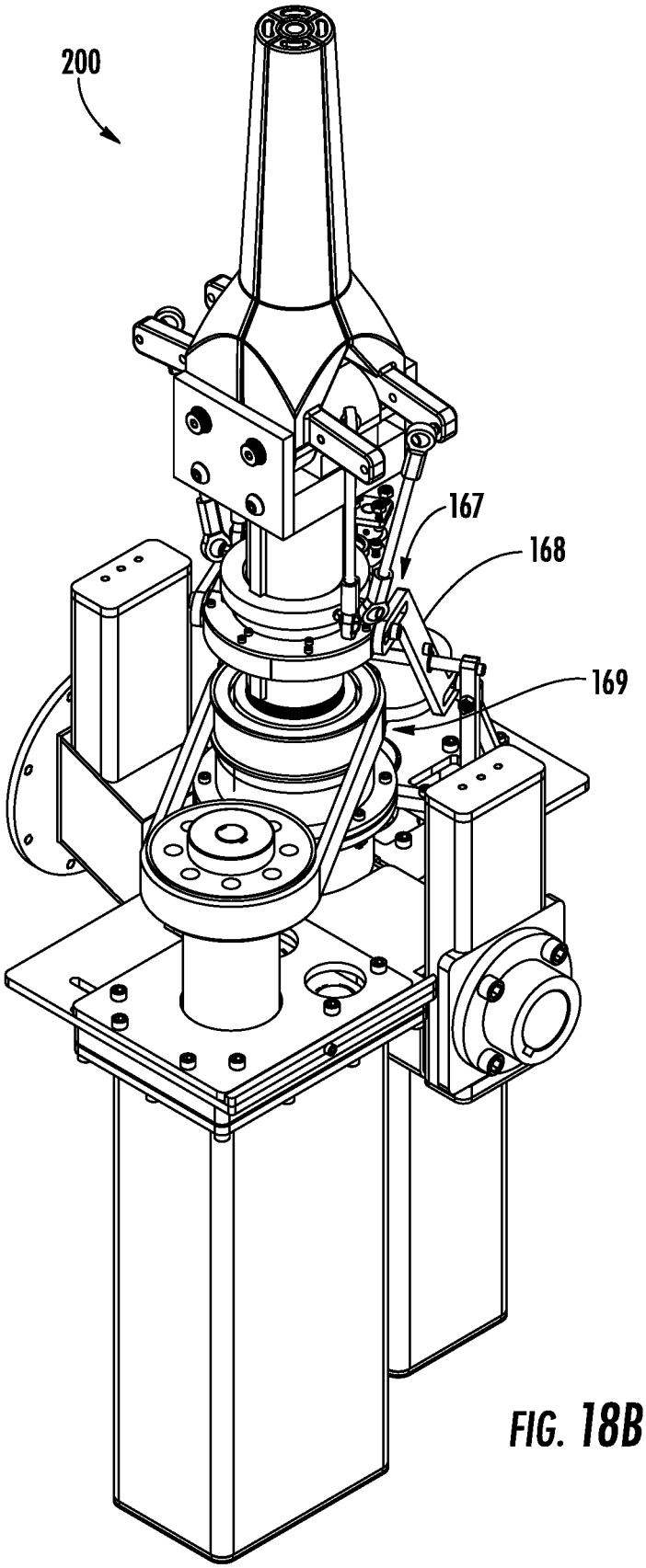
Figure 18C:
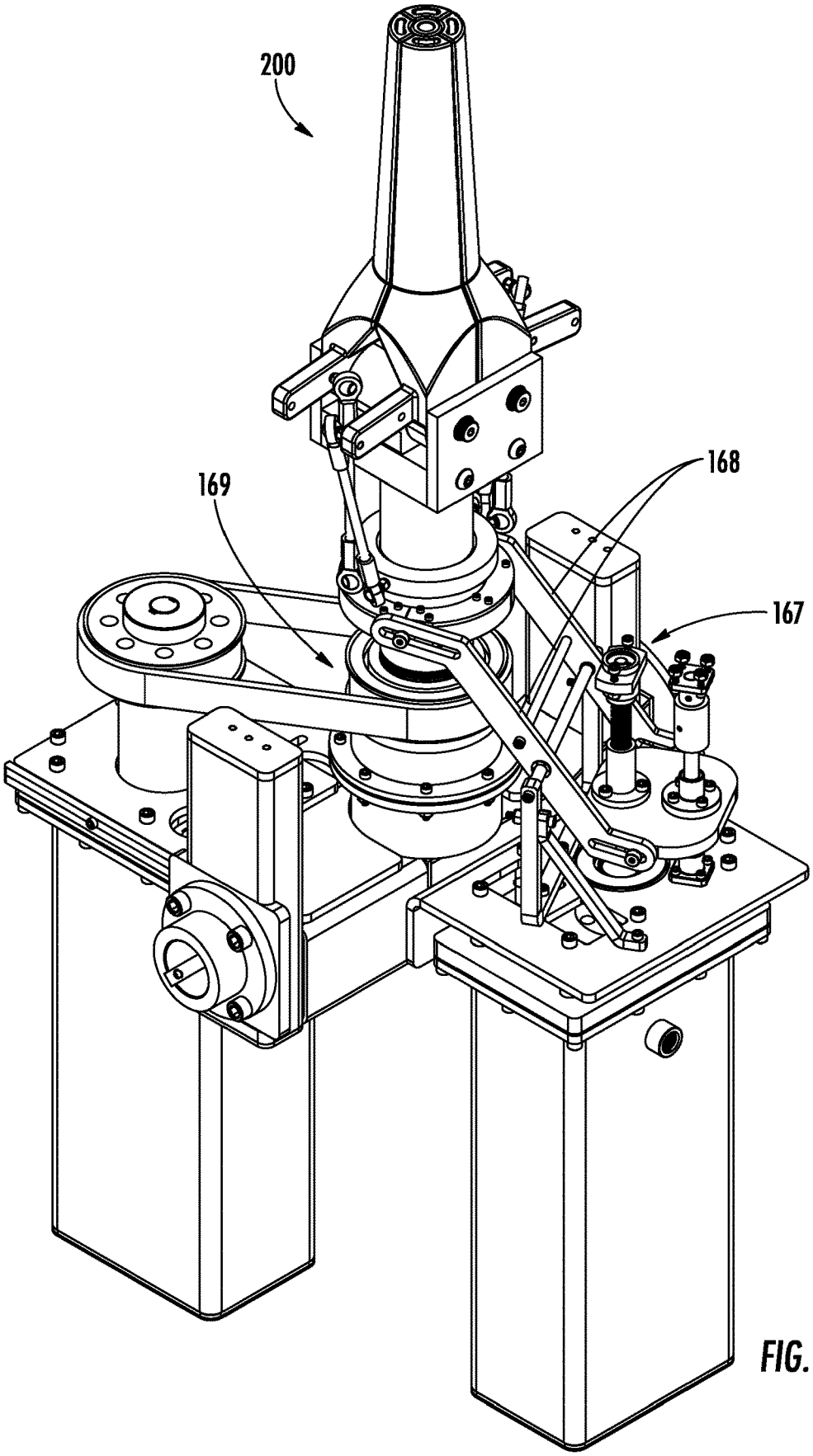

Nozzle assembly 200 may include at least one articulating nozzle 105, and may further include at least one stationary nozzle 150. Each of the at least one articulating nozzles 105 and the at least one stationary nozzle 150 preferably include an orifice 110. In one example, the nozzle assembly 200 may include four articulating nozzles 105 and a single stationary nozzle 150. An alternate embodiment of the nozzle assembly 200 may include more or less articulating nozzles 105 and/or additional stationary nozzles 150, or no stationary nozzle 150. The articulating nozzles 105 and stationary nozzle 150, in one example, may be supported by support arms 155, the support arms 155 may be further connected to the water manifold 130. In one embodiment, the articulating nozzles are further connected to a slide member 145 via link arms 160, wherein the articulating nozzles 105 articulate in response to movement of the slide member 145, e.g., in an up and down direction. In one example, a first end of each of the link arms 160 may be connected to a respective articulating nozzle 105 at a first connection point 163, and a second end of each of the link arms 160 may be connected to the slide member 145 at second connection point 165. With reference to FIGS. 18A-18C, slide member 145 may be connected to a movement controller 167 via, for example, an actuator member 168, which when actuated moves the slide member 145 vertically up and down. The movement may be driven by any of a number of different types of devices, such as a pneumatic actuator, a hydraulic actuator, an electric actuator, a motor, belt system, rollers, or any other suitable device, mechanism, and/or technique. Again with reference to FIGS. 18A-18C, a rotational fitting 169 may be mounted at a base portion of the nozzle assembly 200 and may be used to rotate the nozzle assembly 200, and may be powered by a device such as a pneumatic actuator, a hydraulic actuator, an electric motor, belt system, rollers, or any other suitable device, mechanism, and/or technique. It will be appreciated that some embodiments of the inventive subject matter may omit this rotational capability.

FIGS. 7, 8, and 15 depict the nozzle assembly 200 in a first, closed position. FIG. 7 is a perspective view of the nozzle assembly 200 in a first, closed position in which the articulating nozzles 105 are in a substantially vertical orientation abutting the stationary nozzle 150. FIG. 8 is a section view of the nozzle assembly 200 in the closed position. In the closed position, the nozzle assembly 200 may produce a single output stream 115, or the appearance of a single output stream 115, that results from combining the outputs of one or more of the articulating nozzles 105 and/or the stationary nozzle 150, as illustrated in FIG. 15. It should be appreciated that some embodiments of the inventive subject matter may not include one or more articulating nozzles 105 that reach a full closed position or touch any of stationary nozzles 150. Furthermore, it is possible that articulating nozzles 105 that are fully closed may or may not produce a single output stream 115. They may produce one or more output streams and articulate into a position where the nozzle outputs any other number of streams, e.g., an embodiment in which the nozzle produces (x) streams in the closed position and (x+y) streams in the open position, where (x) and (y) are both ≥(1).

Figure 16:
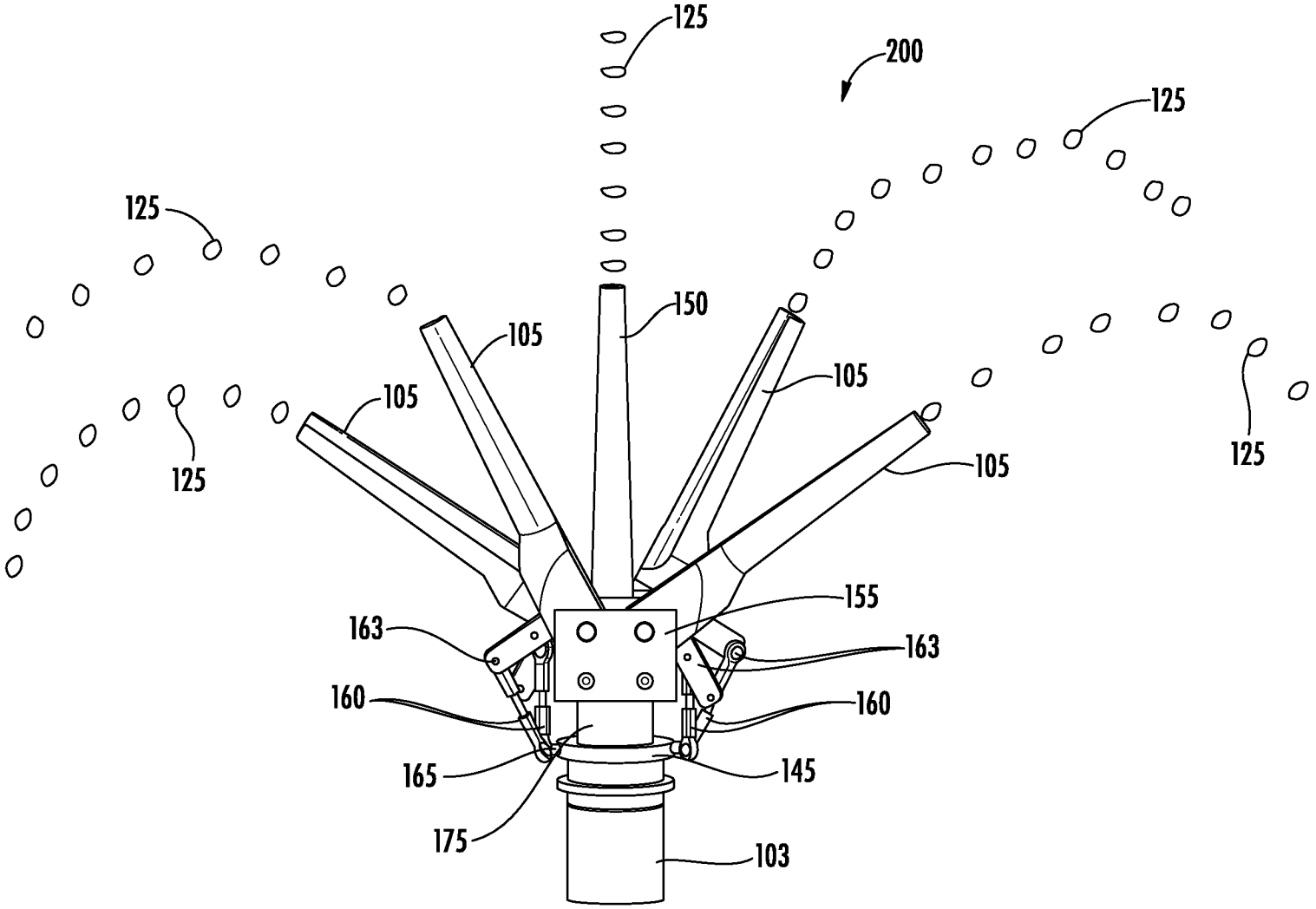
FIG. 16 is side view of the multi-stream nozzle assembly of FIG. 9 in a second state producing exemplary multiple streams.
Figure 17:
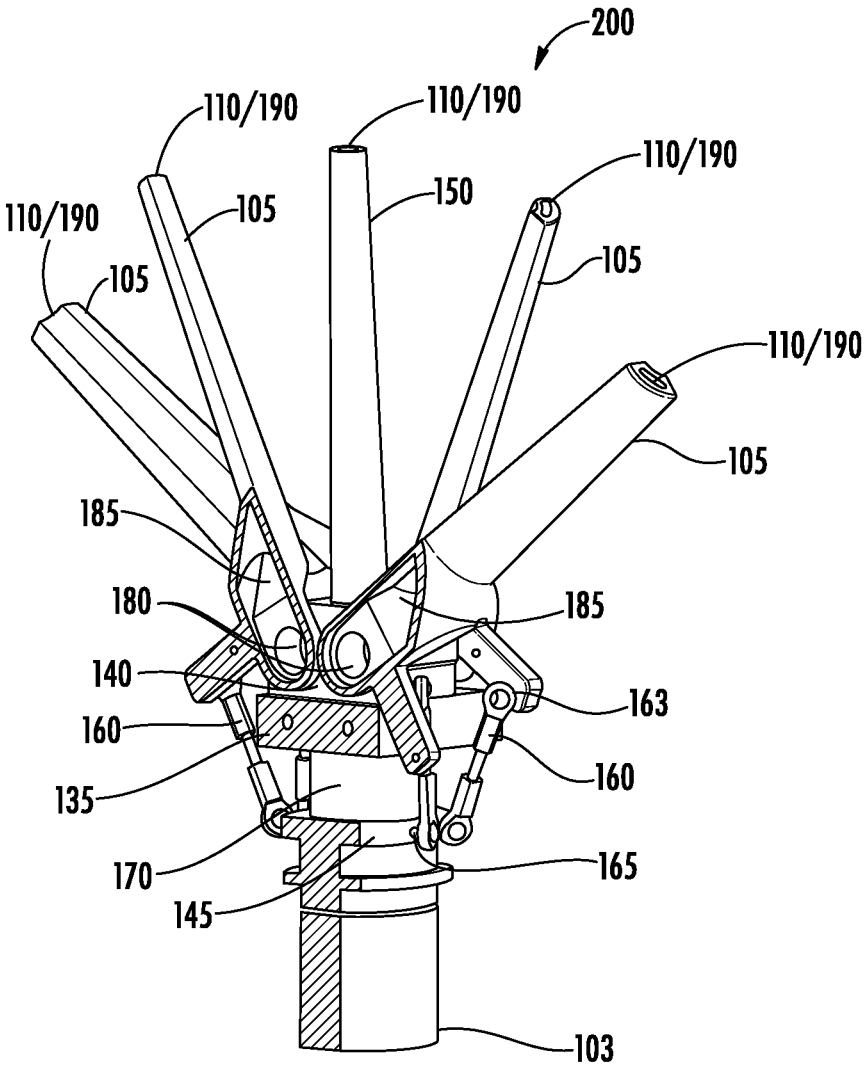
FIG. 17 is another section view of the multi-stream nozzle assembly of FIG. 9.

FIGS. 9, 10, 16, and 17 depict the nozzle assembly 200 in a second, open position. It will be understood that the open position depicted is one of a number of different open position in which the nozzle assembly 200 may be placed, from the closed position, for example as shown in FIG. 7, to a fully open position wherein the articulating nozzles 105 are maximally deflected away from their vertical (closed) positions, for example as shown in FIG. 9. Although FIGS. 9, 10, and 16 show the articulating nozzles 105 moving along respective planes, an alternate construction of the device may have articulating nozzles 105 that move in other manners. The nozzle assembly 200 may rotate about its axis, utilizing a rotational fitting (not shown) mounted, for example, at the base portion of the nozzle assembly 200, while in any of the open or closed positions, and while changing between open and/or closed position. FIG. 9 is a perspective view of the nozzle assembly 200 in an open position, FIGS. 10 and 17 are section views of the nozzle assembly 200 in an open position. As shown in FIG. 16, the nozzle assembly 200 in an open position can produce multiple streams 125 corresponding to respective ones of the articulating nozzles 105 and the stationary nozzle 150. Thus, the nozzle assembly 200 can successfully separate the single output stream 115, or the appearance of a single output stream 115, produced when closed to multiple unique streams 125 when in an open position.

FIG. 11 depicts the water manifold 130, which may include a water inlet manifold 135 and water outlet manifold 140, as shown in more detail in FIGS. 12 and 13 respectively. Water inlet manifold 135, in one embodiment, may include an inlet channel 170 formed therein, and may be affixed atop a water inlet pipe 175 for receiving water from a water source (not shown). Water outlet manifold 140, in one embodiment, may include one or more outlet channels 180 formed therein (preferably one for each of the articulating nozzles 105 and stationary nozzle 150), and may be affixed atop, and in liquid communication with, water inlet manifold 135 for receiving water from inlet channel 170. The one or more outlet channels 180 of water outlet manifold 140 are preferably aligned with and in fluid communication with corresponding orifices 110 of the articulating nozzles 105 and the stationary nozzle 150. In one example, water received from water inlet pipe 175 enters the water manifold 130 through the inlet channel 170 of the water inlet manifold 135 and flows into the water outlet manifold 140. Water outlet manifold 140 diverts the water flow through the one or more outlet channels 180 into corresponding orifices 110 of the articulating nozzles 105 and the stationary nozzle 150.

FIG. 14 depicts slide member 145. In one embodiment, slide member 145 may be affixed about water inlet pipe 175 at a point below water manifold 130. Slide member 145 is preferably affixed about water inlet pipe 175 in a slideable manner, whereby slide member 145 may moveable to travel up and down the water inlet pipe 175 in a vertical direction. In a preferred embodiment, slide member 145 is further connected to articulating nozzles 105 via one or more link arms 160, such that movement of slide member 145 causes articulating nozzles 105 to articulate between their closed and opened positions (or any point in between) or vice versa. In one example, as slide member 145 moves vertically upward the articulating nozzles 105 move to their closed position and when slide member 145 moves vertically downward the articulating nozzles 105 move to their opened position.

In operation, water from a water source may enter the nozzle assembly 200 through the water inlet pipe 175. The water may then enter the water manifold 130 through the inlet channel 170 of water inlet manifold 135, where the water is directed into the water outlet manifold 140. The water outlet manifold 140 diverts the water via outlet channels 180 into proximal ends 185 of the orifices 110 of corresponding one or more articulating nozzles 105 and/or one or more stationary nozzles 150. The proximal ends 185 of the orifices 110 may, in one embodiment, include a chamber formed at the bottom portion of their corresponding articulating nozzle 105 and/or stationary nozzle 150, wherein the chamber portions may have a larger diameter/volume than the remaining portion of their corresponding orifices 110. In alternate embodiments, the chamber may have a same or similar diameter/volume as that of the remaining portion of their corresponding orifices 110. The water flow may then exit distal ends 190 of the orifices 110 of corresponding one or more articulating nozzles 105 and/or one or more stationary nozzles 150. While in operation, articulating nozzles 105 may be articulated between their closed and open position (or any position there between) by controlled movement of slide member 145. As slide member 145 is raised or lowered it causes link arms 160 to cause their corresponding articulating nozzle 105 to articulate accordingly. Articulating nozzles 105 may be articulated to their fully opened, fully closed, or any position there between to form various water displays. Additionally, the height of the water exiting the one or more articulating nozzles 105 and/or one or more stationary nozzle 150 may be controlled by adjusting the water pressure accordingly.

Figure 19:
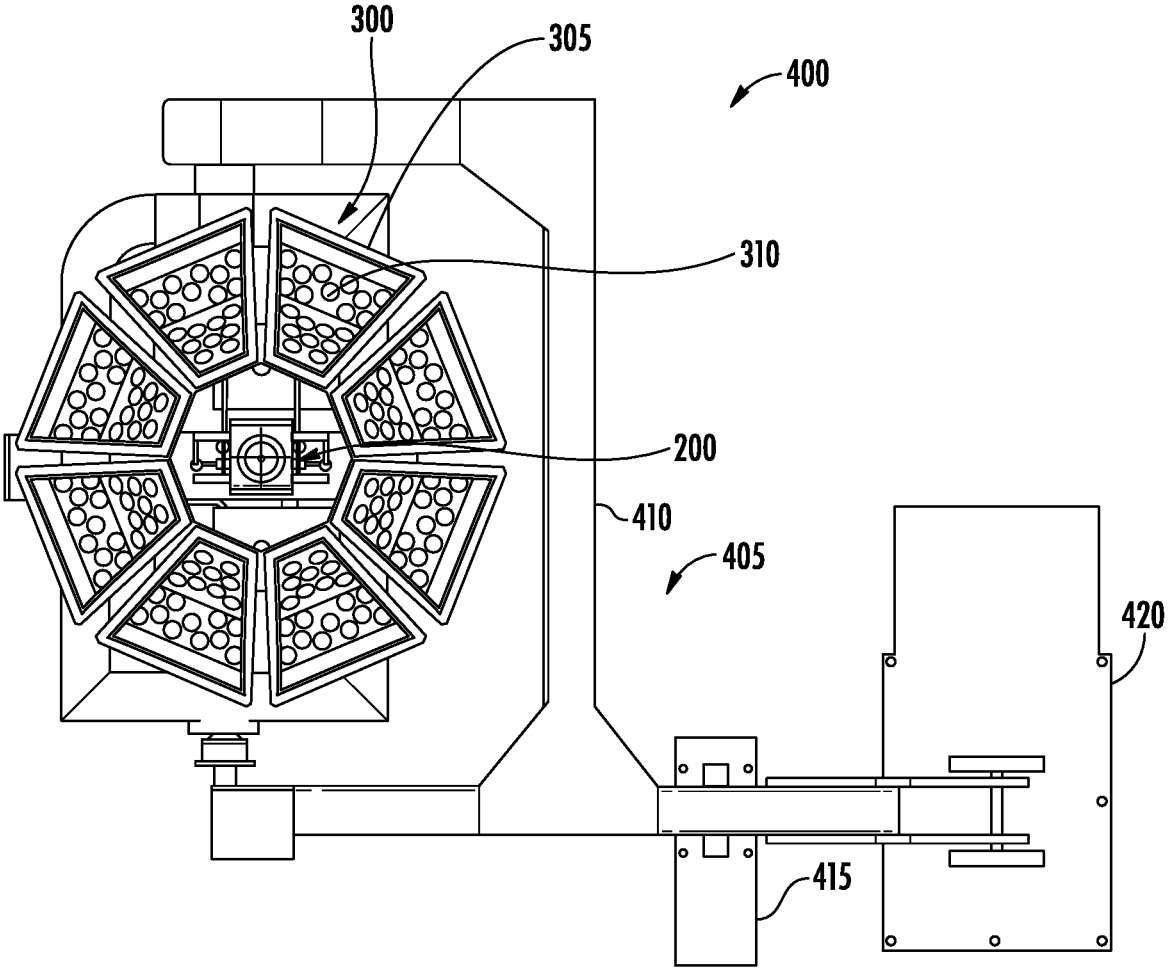
FIG. 19 is a top view of a light system according to some embodiments.
Figure 20:
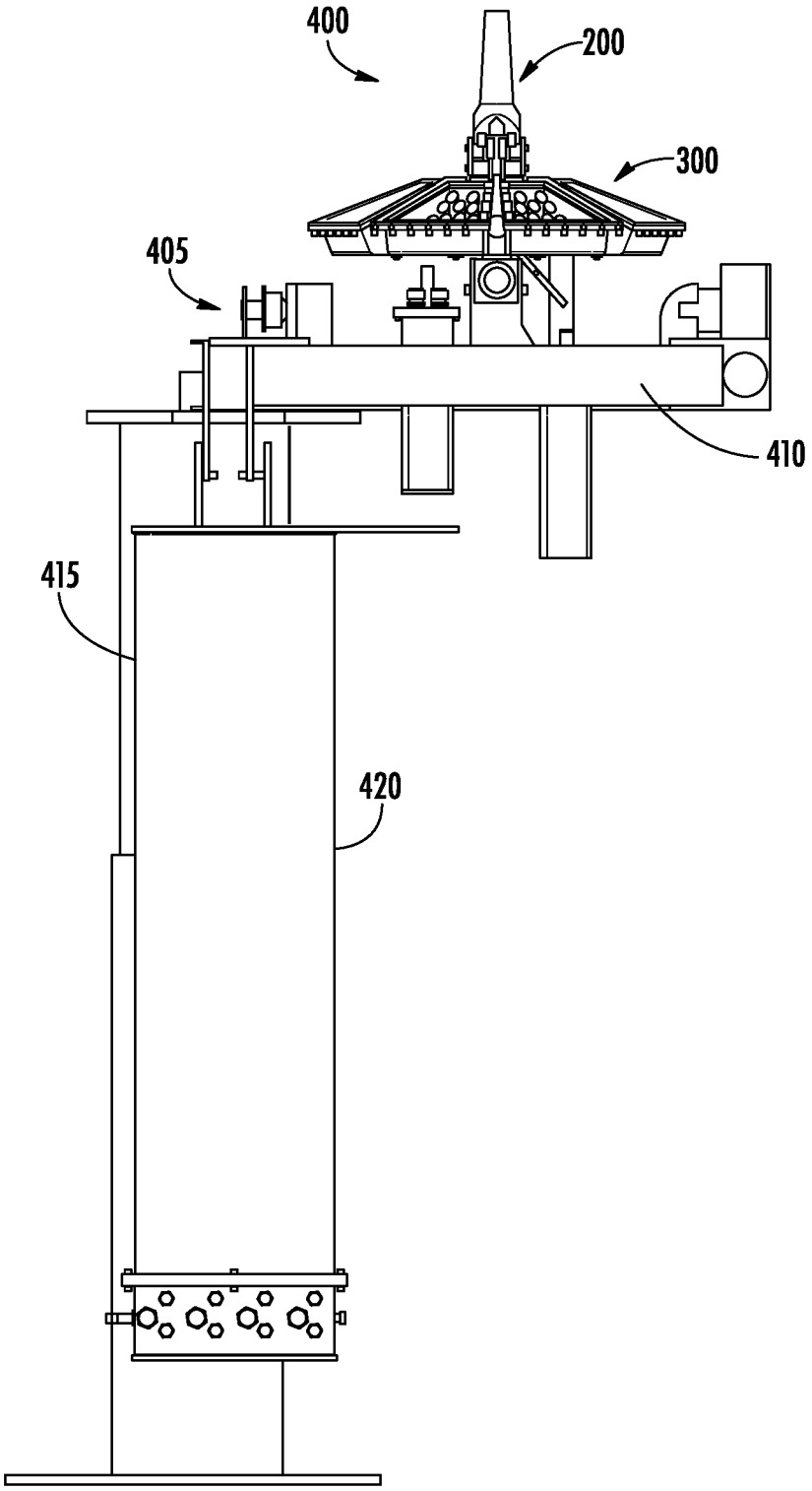
FIG. 20 is a side view of a fountain system according to some embodiments.
Figure 21:
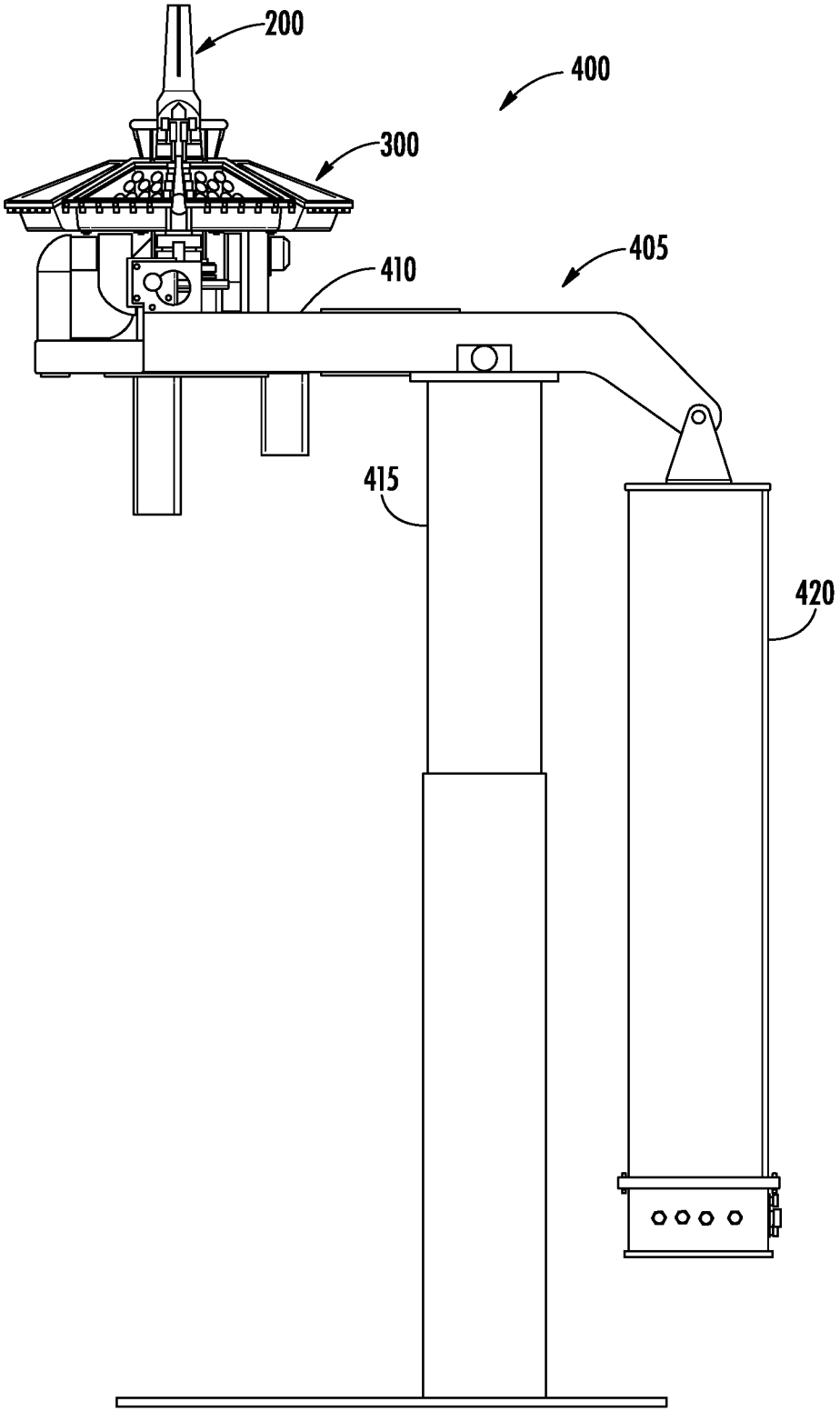
FIG. 21 is another side view of the fountain system according to some embodiments.

With reference to FIGS. 18-20, in another embodiment, the nozzle assembly 200 may further be coupled with a lighting system 300. Lighting system 300 may include one or more light panels 305. The light panels 305 may each include one or more lights 310, e.g., LED, or other suitable lights, arranged therein. Each light panel 305 may be individually controllable. Further, lights 310 may be individually controllable and/or in defined groups. Lights 310 may be of any color, or capable of producing various different colors. Each of the light panels 305 may be configured to be capable of being separately controlled. Management of directional light output and intensity may be controlled via software algorithm. In operation, the lighting system 300, in one example, may use power management and a preset angle of lights 310 to change the throw of the light to illuminate the water streams depending on the spread of the nozzles of nozzle assembly 200.

In one embodiment, the lights 310 of light panels 305 may be arranged in a pattern, for example, in a tiered configuration within each of their respective light panels 305. In one example, lights 310 may be mounted to light panels 305, such that the light 310 are generally perpendicular to horizontal and/or are mounted such that they are generally perpendicular to the surface portion of the light panel to which they are mounted. Each of the light Panels 305 may be of a generally triangular or wedge shape, and the light panels 305 may be configured in an overall generally circular or ring arrangement about the periphery of the nozzle assembly. In such a configuration the nozzle assembly 200 is located in a generally center portion of the circular arrangement of light panels 305. Alternatively, light Panels 305 may be of any shape, and the light panels 305 may be configured in any number of arrangements about the periphery of the nozzle assembly, e.g., square, diamond, oval, triangular, or other general configuration. In such a configuration the nozzle assembly 200 is located in a generally center portion of the circular arrangement of light panels 305.

Light system 300, is preferably constructed of water proof/resistant components to allow for use in a wet environment such as would be present with the use of nozzle assembly 200. In one example, the lights 310 of light panels 305 may be housed in substantial waterproof/water resistant housing and covered with a transparent or semi-transparent substantial waterproof/water resistant cover.

In an embodiment, nozzle assembly 200 and light system 300 may be operatively coupled together to form a fountain system 400. Fountain system 400 may include nozzle assembly 200, light system 300, and a controllable mount 405. In one embodiment, nozzle assembly 200 and light system 300 are operably affixed to controllable mount 405. Controllable mount 405 may be a robotic system that may control one or more of the flow of water to and movement of nozzle assembly 200 and/or control light system 300, e.g., movement, illumination, color, and/or sequencing. Controllable mount 405 may be configured to control the nozzle assembly 200 and light system 300 in coordination with one another to generate a dynamically changing defined water display.

In one embodiment, controllable mount 405 may include a mount arm 410, a mount base 415, and may further include a control box 420. Mount arm 410 may be fixedly attached to mount base 415, or affixed to allow for mount arm 410 to move in various directions (e.g., up, down, rotate, tilt, etc.). Nozzle assembly 200 and light system 300 are preferably affixed to mount arm 410. Control box 420 may also be affixed to mount arm 410. Control box 420 may be in operative communication with one or both of the nozzle assembly 200 and light system 300, via, for example, various wiring and hoses, and may include various control modules and/or pumps (e.g., submersible water pump, hydraulic pumps).

Mount base 415 is preferably secured in the ground or otherwise secured in place to hold the fountain system 400 securely in place. When installed mount base 415 may be fully or partially hidden underwater. In one embodiment, when installed, mount arm 410 may be fully or partially hidden underwater, for example, when not in use, and may be raised when in use to elevate the nozzle assembly 200 and light system 300 to above, or at, water level.

In use, light from light system 300 may be shown on a water pattern/display formed by the nozzle assembly 200 to form a colored water display. The light panels 305 may be controlled to direct the light to certain portions of the water pattern, e.g., by moving the light system 300 and/or one or more of the light panels 305. Lights 310 may further be controlled, either individually or in groups, to provide various colors and/or color patterns onto the water display, thereby giving the appearance of the water being colored.

In this specification, there have been disclosed embodiments of the inventive subject matter and, although specific terms are employed, they are used in a generic and descriptive sense only and not for purposes of limitation. The following claims are provided to ensure that the present application meets all statutory requirements as a priority application in all jurisdictions and shall not be construed as limiting the scope of the inventive subject matter.

That which is claimed:

1. A nozzle assembly comprising:

a. a plurality of nozzles, comprising a plurality of moveable nozzles and at least one stationary nozzle, wherein the plurality of moveable nozzles are substantially parallel with and substantially surround the at least one stationary nozzle in a first state, and wherein the plurality nozzles are configured to transition between the first state in which streams produced by the plurality of nozzles combine to form a unitary stream, or the appearance of a unitary stream, and at least one second state in which the plurality of nozzles produce a different number of streams, or the appearance of a different number of streams from the first state;

b. an actuator configured to transition the plurality of moveable nozzles between the first and second states; and wherein in the first state nozzle openings of the plurality of moveable nozzles and that of the at least one stationary nozzle are substantially coplanar.

2. The assembly of claim 1, wherein each of the moveable nozzles is configured to move between a closed position and an open position.

3. The assembly of claim 2, wherein the moveable nozzles comprise a first set of moveable nozzles that pivot about a first axis and a second set of moveable nozzles that pivot around a second axis parallel to the first axis.

4. The assembly of claim 3, wherein the first set of moveable nozzles comprise a first nozzle having movement that stops at a first angle with respect to the closed position and a second nozzle having movement that stops at a second angle with respect to the closed position.

5. The assembly of claim 2, wherein the moveable nozzles comprise a first set of moveable nozzles that move along a first plane and a second set of moveable nozzles that move along a second plane parallel to the first plane.

6. The assembly of claim 2, wherein the actuator comprises a sliding member configured to move vertically and wherein the moveable nozzles are linked to the sliding member such that the moveable nozzles move between the closed position and the opened positions responsive to vertical movement of the sliding member.

7. The assembly of claim 2, wherein the actuator comprises a rotating or gear driven member configured such that the nozzles move between the closed and open positions responsive to rotational movement of the drive member.

8. The assembly of claim 1, wherein the one or more stationary nozzles are configured to contribute to the collective stream when the moveable nozzles are in the first state.

9. The assembly of claim 1, wherein the moveable nozzles comprise a first set of moveable nozzles that pivot about a first axis on a first side of the stationary nozzle and a second set of moveable nozzles that pivot around a second axis parallel to the first axis on a second side of the stationary nozzle.

10. The assembly of claim 9, wherein a first nozzle of the first set of moveable nozzles comprises a first nozzle that stops at a first angle of inclination with respect to vertical and a second nozzle that stops at a second angle of inclination with respect to vertical.

11. The assembly of claim 1, wherein the moveable nozzles comprise a first set of moveable nozzles that move along a first plane on a first side of the stationary nozzle and a second set of moveable nozzles that move along a second plane parallel to the first plane on a second side of the stationary nozzle.

12. The assembly of claim 11, wherein a first nozzle of the first set of moveable nozzles comprises a first nozzle that stops at a first angle of inclination with respect to vertical and a second nozzle that stops at a second angle of inclination with respect to vertical.

13. The assembly of claim 1, further comprising a light system, wherein the nozzle assembly and light system are operatively connected together and configured to operate in coordination with one another to generate a dynamically changing defined water display.

14. The assembly of claim 13, wherein the light system comprises:

a. one or more light panels; and b. one or more lights arranged in the one or more light panels, wherein the lights are capable of producing white light or colored lighting.

15. The system of claim 14 wherein the one or more light panels are arranged about the nozzle assembly.

16. The system of claim 14 wherein the lights are arranged such that an angle of illumination can be controlled in either spherical or cartesian coordinates.

17. The system of claim 14 wherein the lights are arranged such that a width of illumination can be controlled in either spherical or cartesian coordinates.

18. The assembly of claim 1, further comprising a controllable mount, wherein the nozzle assembly is operatively connected to the controllable mount.

19. The assembly of claim 18, wherein the controllable mount comprises:

a. a mount base; and b. a mount arm affixed to the mount base.

20. The assembly of claim 19 wherein the nozzle assembly is operatively attached to the mount arm.

21. The assembly of claim 18, further comprising a light system, wherein the nozzle assembly and light system are operatively connected to the controllable mount and configured to operate in coordination with one another to generate a dynamically changing defined water display.

22. The assembly of claim 21, wherein the light system comprises:

a. one or more light panels; and b. one or more lights arranged in the one or more light panels, wherein the lights are capable of producing white light or colored lighting.

* * * * *